US005518161A

United States Patent [19]

Thompson

[11] Patent Number: 5,518,161

[45] Date of Patent: May 21, 1996

[54] IMPACT ACTUATED TOOL WITH CONFIGURABLE MUZZLE FOR DRIVING VARYING LENGTH FASTENERS

[75] Inventor: William J. Thompson, Fullerton, Calif.

[73] Assignee: Illinois Tool Works, Inc., Glenview, Ill.

[21] Appl. No.: 407,972

[22] Filed: Mar. 22, 1995

Related U.S. Application Data

[62] Division of Ser. No. 147,935, Nov. 5, 1993, Pat. No. 5,425,488.

[51] Int. Cl.[6] ..... B25C 1/14

[52] U.S. Cl. ..... 227/8; 227/10

[58] Field of Search ..... 227/8, 9, 10, 11

[56] References Cited

U.S. PATENT DOCUMENTS

| | | | |
|---|---|---|---|
| 1,365,869 | 1/1921 | Temple . | |
| 1,365,870 | 1/1921 | Temple . | |
| 2,213,435 | 9/1940 | Temple, Jr. . | |
| 2,395,354 | 2/1946 | Temple . | |
| 2,479,431 | 8/1949 | Temple . | |
| 2,716,813 | 9/1955 | Smyres . | |
| 3,203,609 | 8/1965 | Diehl . | |
| 3,212,535 | 10/1965 | Broske . | |
| 3,235,154 | 2/1966 | Mulno . | |
| 3,297,224 | 1/1967 | Osborne . | |
| 3,468,466 | 9/1969 | Wackrow . | |
| 3,481,143 | 12/1969 | Hsu . | |
| 3,494,018 | 2/1970 | Helderman et al. . | |
| 3,540,141 | 11/1970 | Butler . | |
| 3,547,333 | 12/1970 | Helderman . | |
| 3,554,425 | 1/1971 | Oesterle . | |
| 3,589,584 | 6/1971 | Ohlsson . | |
| 3,643,850 | 2/1972 | Endo et al. | 227/10 |
| 3,665,583 | 5/1972 | Helderman | 227/10 |
| 3,678,808 | 7/1972 | Hsu et al. . | |
| 3,679,118 | 7/1972 | Maier et al. | 227/10 |
| 3,797,721 | 3/1974 | Clumb . | |
| 3,805,472 | 4/1974 | Helderman . | |
| 3,860,161 | 1/1975 | Engstrom et al. | 227/10 |
| 3,981,424 | 9/1976 | Maier . | |
| 4,074,843 | 2/1978 | Oesterle . | |
| 4,114,792 | 9/1978 | Pomeroy . | |
| 4,196,834 | 7/1980 | Beton . | |
| 4,201,324 | 5/1980 | Maier et al. . | |
| 4,479,599 | 10/1984 | Conrad . | |
| 4,684,050 | 8/1987 | Masas | 227/10 |
| 4,804,127 | 2/1989 | Kirkman . | |
| 4,883,211 | 11/1989 | Phillipp et al. . | |
| 4,899,919 | 2/1990 | Clumb . | |
| 5,016,802 | 5/1991 | Haytayan . | |
| 5,135,150 | 8/1992 | Chun . | |

*Primary Examiner*—Scott A. Smith
*Attorney, Agent, or Firm*—Price, Gess & Ubell

[57] ABSTRACT

This invention relates to an impact actuated tool for driving a fastener by an explosive charge, particularly a tool having a housing with a barrel axially slidably mounted within the front end. A nosepiece is fixed to the front of the barrel with a muzzle at its front end for receiving a fastening element that is to be secured in a ceiling, wall or the like. A piston is slidably mounted within the bore in the barrel. The barrel is biased forwardly in the firing direction. At the rear of the tool a handle engages a firing pin which is slidably mounted within the rear end of the bore. The firing pin is biased rearwardly towards the back end of the tool. One embodiment of the tool includes a ball lock safety device to allow discharge only when the muzzle of the tool is pointed in an upward direction. The tool is fired by impacting the nosepiece against a surface to effect displacement of the barrel and firing pin against their respective biasing springs.

28 Claims, 4 Drawing Sheets

IMPACT ACTUATED TOOL WITH CONFIGURABLE MUZZLE FOR DRIVING VARYING LENGTH FASTENERS

This application is a divisional of U.S. Ser. No. 08/147,935, filed Nov. 5, 1993.

BACKGROUND OF THE INVENTION

1 . Field of Invention

The present invention relates to an impact actuated tool for driving fasteners into work surfaces such as ceilings, walls and the like, and more particularly to a lightweight impact actuated tool that operates in a relatively silent, safe and trouble free manner.

2. Description of the Prior Art

A variety of explosive actuated tools for driving fasteners have been developed over the years. Such tools include those shown in U.S. Pat. Nos. 3,665,583; 3,407,982; 3,797,721; 3,805,472; 4,655,380 and the patents cited therein. However, the prior art explosive actuated driving tools suffer from several disadvantages and limitations. Generally, explosive actuated driving tools are relatively complex in construction and costly to manufacture. In addition, due to the placement of the venting mechanism of the combustion chamber, many of these tools suffer from the disadvantages that they are relatively noisy. Furthermore, the pistol type driving tools are heavy, cumbersome, and because of the pistol-type trigger mechanisms, are not easily adapted to be mounted to a pole assembly for driving fasteners into overhead ceilings.

SUMMARY OF THE INVENTION

The present invention provides an improved impact actuated tool without a pistol-type trigger mechanism for driving a fastener into a work surface such as a ceiling, wall or the like. The present invention further provides an impact actuated tool which is durable in use, yet is lightweight, compact, and easy to operate. In addition, the invention provides an impact actuated tool which is quiet in operation, yet provides driving force superior to the prior art.

One significant advantage of the tool of the present invention is that it achieves an improvement in driving force because at the moment of actuation every element of the tool is in direct contact with every other element, and the momentum of the tool is in the direction the fastener is desired to go. As a result of the tool elements being in direct contact all of the explosive power of the cartridge is utilized to drive the fastener into the receiving substrate. Thus, superior driving force is achieved over much of the prior art which trades off driving power for versatility. For example, much of the prior art was designed for use as a general purpose tool with gap spaces between some of the elements of the tool so that the tool could accommodate fasteners with lengths between 1–3 inches. As a result, these prior art devices experienced a reduction in driving power since the explosive gases must expand into the gap area and compressive power is wasted in driving the elements through the gap lengths. In the present invention the explosive gases cannot escape or expand without performing the work of driving the piston forward.

Another means by which the tool achieves an improvement in driving force is by selective placement of the vent ports in the barrel. For example, for a standard 1¼' fastener, the high velocity gases are permitted to expand into and vented through a selectively located port only after the fastener is completely driven into the workpiece. Thus, an improvement in driving force is achieved since there is no exit means from the barrel bore for the expanding gases of the propellant and thus, no drop in the driving force being applied to the fastener until after the fastener is fully seated in the workpiece.

As discussed above, the prior art often traded driving power for versatility to permit fasteners of different lengths to be utilized with different propellant charges to penetrate different materials. As a result, these prior art devices experience a reduction in driving power, since the explosive gases begin to be vented as soon as the rear of the piston moves past a slotted aperture, thereby relieving the driving force on the fastener. In the present invention the explosive gases cannot escape the barrel bore without performing the work of driving the piston forward.

In a preferred embodiment, the invention is further provided with a safety device mounted to the rear of the housing. The device comprises a ball placed within a longitudinal internal groove with a shoulder within the safety device. The ball is sized to lodge between the shoulder and the wall of the groove to prevent axial movement of the handle when the muzzle of the tool is oriented in a downward direction.

Other objects and merits and a fuller understanding of the present invention will be obtained by those having ordinary skill in the art when the following detailed description of the preferred embodiment read is in conjunction with the accompanying drawings.

Brief Description of the Drawings FIG. 1 is a longitudinal sectional view of a tool, loaded with a cartridge and ready to fire, constructed in accordance with the invention.

DETAILED DESCRIPTION OF THE INVENTION

Figure 1:
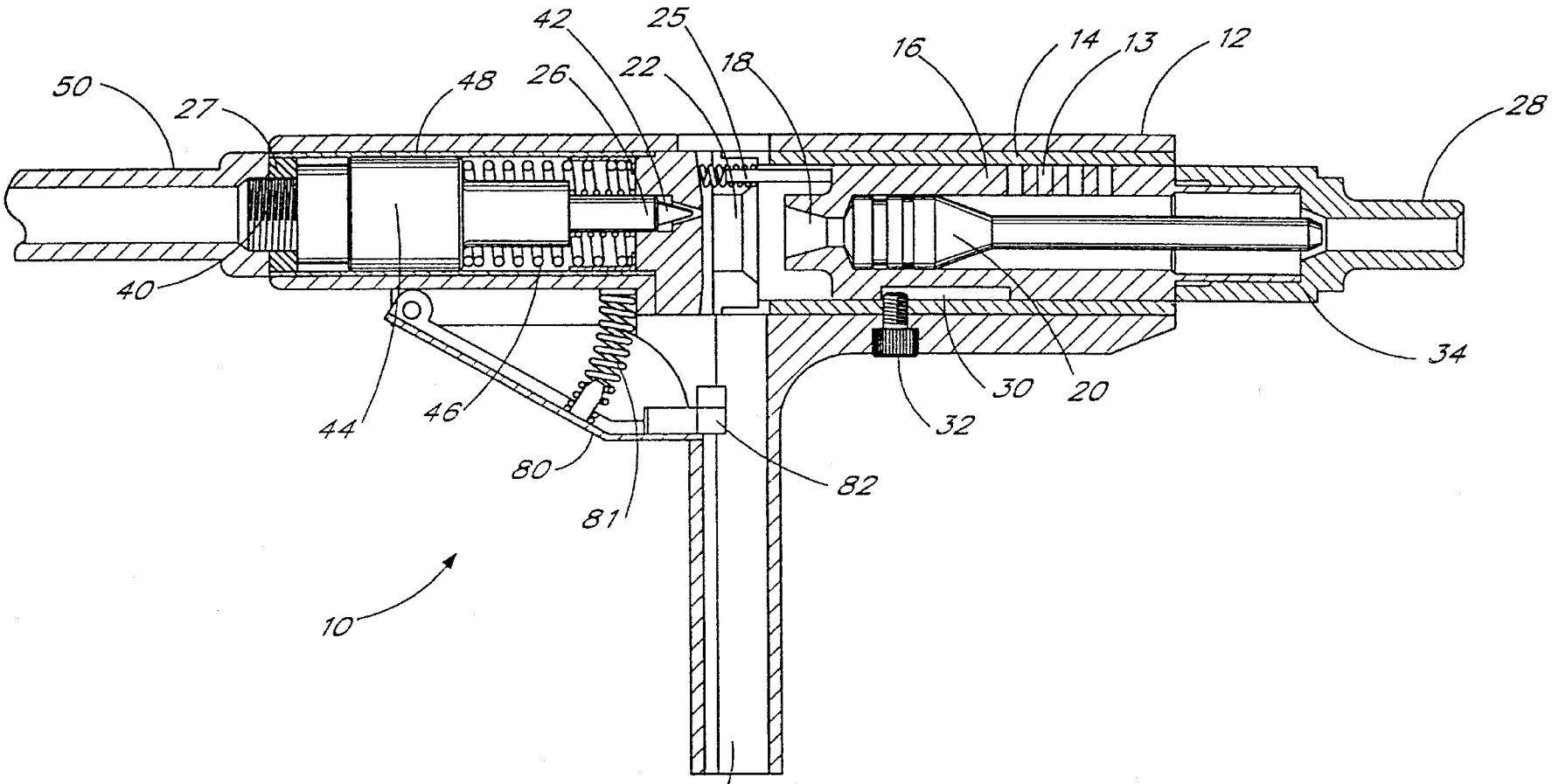

Referring now to the drawings, particularly FIG. 1, there is shown an impact actuated tool 10 for driving fasteners embodying the present invention. The tool 10 is cylindrically-shaped and utilizes a powder load to actuate a piston 20 for driving fasteners into a hard receiving substrate such as concrete, wood or solid-steel. The tool 10 has a long pole handle 50 that both operates as a slidable ram for firing an explosive charge, and allows the operator to extend the tool body to the ceiling for the driving of overhead fasteners. The handle allows the operator to extend the tool to the desired substrate which is often located two to ten feet overhead from and out of reach of the operator of the tool. The fastener 30 utilized by the tool may be one of the many fasteners well known in the art. Such fasteners typically have a head portion 30*a* and a body or shank portion 30*b*. Often, a plastic fluted centering member 30*c* is positioned around shank 30*b*, as is well known in the art.

The impact actuated tool includes a housing 12 which has a bore extending through its entire length. The tool 10 has a front end spaced in the firing direction and a rear end in the opposite direction.

The front portion of the bore is lined with a tubular sleeve 14. A cylindrically-shaped barrel 16, having a central bore extending therethrough, is mounted within the front end of the sleeve 14. The barrel 16 has a forward end in the firing direction and a rear end or breech 18 in the opposite direction. At the front end of the barrel 16, the bore is sized to receive a piston 20. A firing chamber 22 is formed at the breech end 18, wherein the bore is configured to receive a percussion explodable charge or cartridge 24 which is actuated by a firing pin. The firing chamber 22 communicates with the barrel bore so that when the cartridge 24 is actuated a fastener 30 positioned within the bore is driven from the muzzle of the tool.

The barrel 16 is mounted such that it can axially slide back and forth within the sleeve 14. A slot 30 is formed on the outside of the barrel 16. A screw 32 extends through the housing 12 and sleeve 14 to engage the slot 30 to constrain the barrel 16 to limited longitudinal movement relative to the housing. A first biasing means 25 urges the barrel 16 forwardly in the firing direction. This biasing of the barrel serves the function of displacing the barrel 16 such that another cartridge 24 can be indexed into position for firing. This biasing of the barrel also functions as a safety feature to prevent tool discharge, since the tool 10 can not discharge unless the barrel 16 is axially displaced against the cartridge 24 in the breech end 18. The barrel displacement normally occurs when the tool is impacted against a ceiling.

A piston 20 is positioned within the bore of the barrel 16 such that it can axially slide within the bore.

A plurality of discharge ports 13 formed in barrel 16 define exits for the discharge of combustion gases from the bore of barrel 16, allowing the gases to expand. A small amount of the spent combustion gases will be forced by the internal pressure caused by the cartridge explosion to exit into the annular space between the barrel 16 and the sleeve 14. The "annular space" is not a passageway, but simply the mechanical clearance of the minimal tolerance which is required to permit barrel 16 to freely slide axially within sleeve 14. There are no passages provided into or through sleeve 14 and/or housing 12 for the purpose of permitting the combustion gases to exit the bore of barrel 16 and be discharged into the atmosphere through housing 12 or sleeve 14. The location of the first or most rearward port is such that when a fastener 30 is properly spaced by the nosepiece 34, the high velocity gases are not vented until the fastener 30 is completely driven into the workpiece. Specifically, the first port is positioned at a location in the barrel adjacent to that of the rear of the piston 20 when a standard 1¼" fastener is completely driven into the workpiece. An improvement in driving force is achieved since there is no exit means for the expanding gases of the propellant and thus, no drop in the driving force being applied to the fastener until after the fastener is fully seated in the workpiece.

A nosepiece 34, having a bore extending therethrough is threadedly engaged with the front of the barrel 16. The nosepiece 34 has a forward end in the firing direction which defines a muzzle 28 and a rear end in the opposite direction which is threaded to engaged the barrel 16. The bore in the rear portion of the nosepiece 34 is sized to match the bore of the barrel 16. The bore on the muzzle end 28 of the nosepiece 34 is sized for receiving a fastener 30 to be driven by the tool and secured in a work surface such as a ceiling, wall or the like. The length of the nosepiece 34 is sized to the length of the fastener 30 and may be interchangeable to accommodate a variety of fastener lengths. The nosepiece 34 is properly sized to a particular fastener 30 when it maintains the integrity of contact between the breech, the piston, and the fastener prior to and at actuation.

A firing pin 26 is mounted within the rear end of the housing bore which is lined with a rear barrel liner 48. The firing pin 26 is of a predetermined length with a threaded shank portion 40, a conical firing pin tip 42 and a flange 44 that acts as a shoulder for a spring biasing means 46. The firing pin 26 is inserted through an access hole in the back of the rear barrel liner 48. The firing pin 26 is mounted such that it can slide axially with limited longitudinal movement relative to the housing 12. A second biasing device urges the firing pin 26 rearwardly towards the back end of the housing 12. This biasing functions as a safety feature to prevent tool discharge, since the tool cannot discharge unless the handle 50 and thus the firing pin 26 is axially displaced against the cartridge 24 in the breech end 18. Sufficient displacement of the handle 50 and firing pin 26 would normally occur when the tool is impacted against a ceiling. A retaining ring 27 is threadedly engaged to the rear of the tool housing to retain the firing pin. The threaded shank portion of the firing pin 26 extends through the ring 27 and out of the back end of the tool.

The tool includes an elongated extension handle 50, preferably an axially elongated tube adapted to be grasped at one end by an operator. The opposite end of the handle 50 is threadedly engaged to the shank portion 40 of the firing pin 26, thus the handle 50 operates as a slidable ram for firing an explosive charge contained within the cartridge 24. As hereinafter described, the handle 50 is pushed inwardly to ignite the cartridge 24 to propel the piston 20 to drive the fastener out of the muzzle 28 and into the work surface.

The tool utilizes an industry-standard multi-cartridge strip 70 to propel the piston 20 to the muzzle end 28 of the barrel 16 forcing the fastener 30 into the receiving substrate. The disposable strip magazine 70, preferably fabricated of a resilient material such as plastic, is provided with a plurality of tubular projections defining cartridge receiving recesses. Cartridges 24 are held in the magazine within the recesses so that the forward tips project outwardly in a direction toward the barrel 16 and they are successively aligned with the barrel 16 for successive firing. Typically, ten cartridges in a plastic strip are manually guided into a tool magazine channel 72 until the first load enters the firing chamber 22.

The tool housing defines a magazine channel 72 which extends at substantially right angles to the movement and direction of the barrel 16. A manual indexing lever 80 is mounted to the tool housing 12 and pivots on a fulcrum spring 81 that regulates its travel distance. The spring resistance is overcome with a hand squeeze to depress the lever 80 and upon release the lever 80 returns to a disengaged position.

An external manual indexing lever with an angular shaped tip 82 engages the side serrations on a multiload strip 70 to advance a new cartridge 24 into place, aligning it with the firing chamber 22 and simultaneously removing the spent cartridge away from the firing chamber 22.

The cartridge magazine 70, a plastic band with apertures for retaining cartridges, abuts against the breech 18. In the forward direction, a tubular projection 74 surrounds each cartridge 24. The base of the band provides a sealing engagement with the portion of the barrel 16 surrounding the firing chamber 22. The plastic band of the cartridge magazine forms a necessary wall portion of the closed firing chamber 22 to provides a gas seal upon explosion of the cartridge 24 and during the initial forward movement of the drive piston 20 therein.

Figure 2:
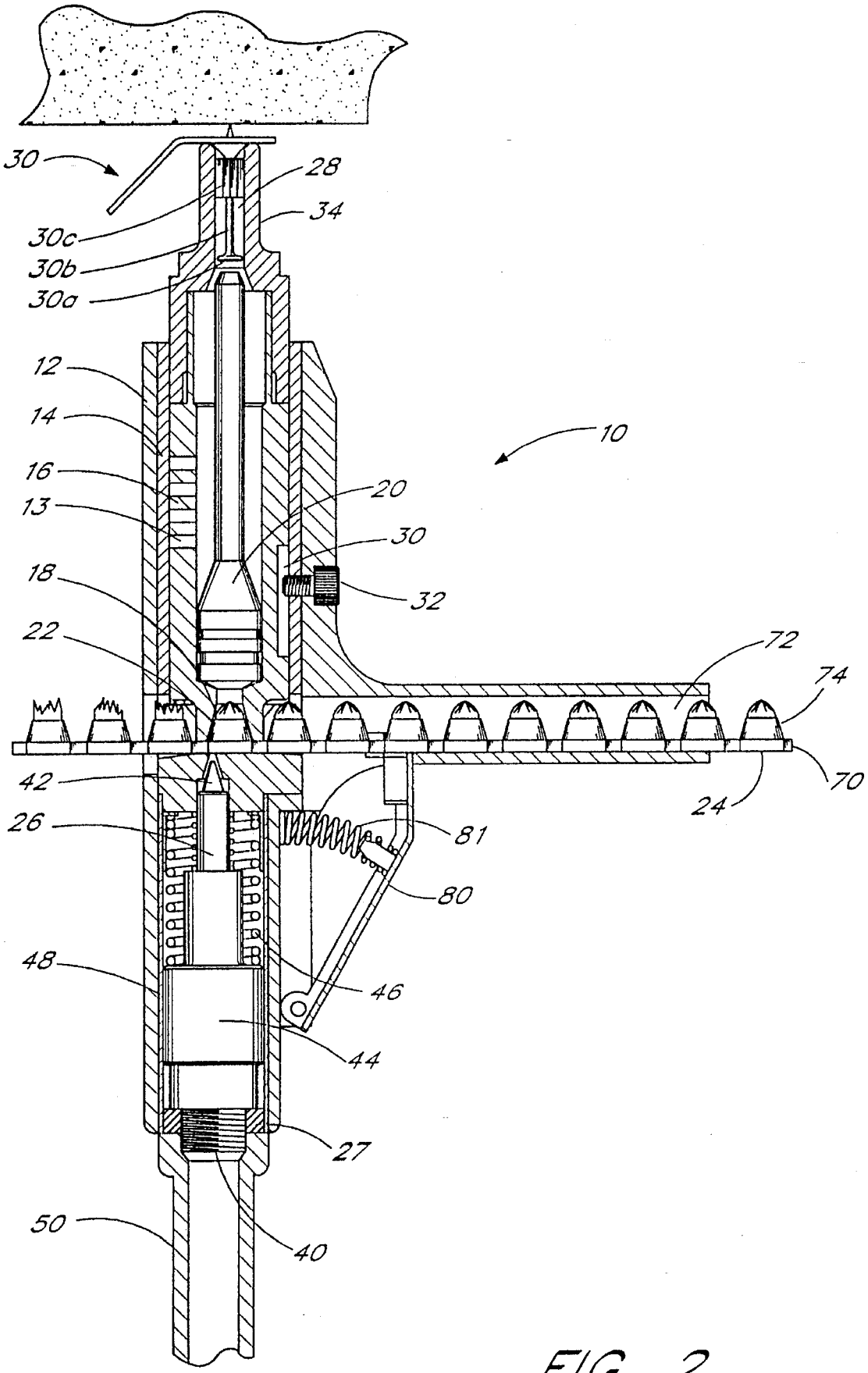
FIG. 2 is longitudinal sectional view of the tool just prior to being fired.
Figure 3:
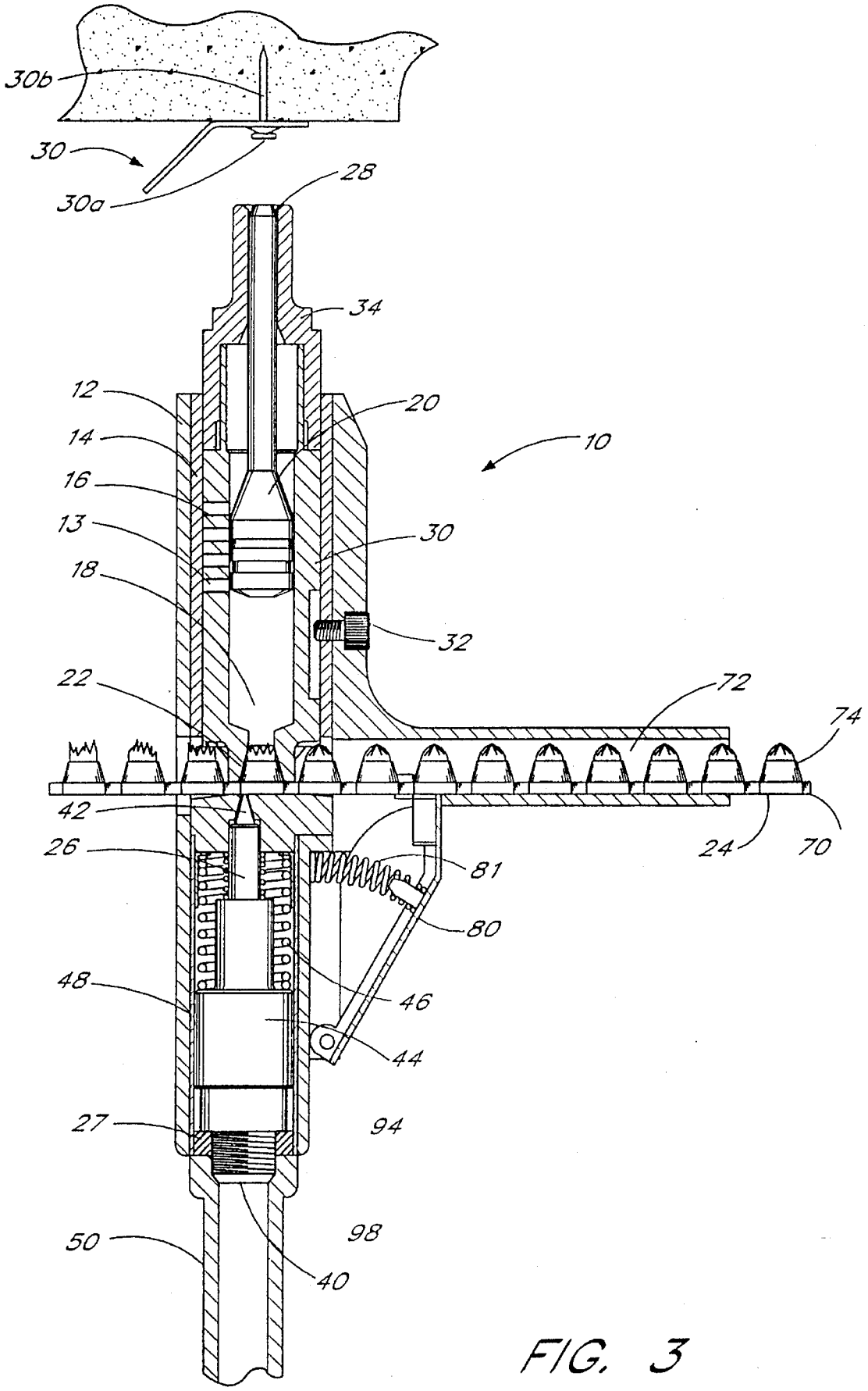
FIG. 3 is longitudinal sectional view of the tool already fired with the piston shown in an extended firing position.

As best shown in FIG. 2, in operation, a fastener 30 is placed into the nosepiece 34 of the barrel 16. Preferably, the head of fastener 30 is in cylindrically sealing relation to the circumference of the bore. Upon insertion, the head of the fastener 30 pushes the captive piston 20 backward to its reset position flush against the firing chamber 22 at the rear of the barrel. This single step eliminates a number of positioning steps required in some of the prior art. Normally, when completely inserted, the tip of the shank portion of the fastener 30 extends outwardly of the end of muzzle 28. In the reset position, the fastener 30, the piston 20, and the firing chamber 22 at the rear of the barrel 16 are in direct contact without spaces or gaps between each element. The tool is made ready to fire by manually indexing a cartridge 24 is into the firing position.

The tool is fired by an operator pushing the tool by its handle to abruptly impact the fastener 30 protruding from the barrel nosepiece 34 against a dense ceiling substrate with sufficient force to depress the nosepiece 34 rearward. As the nosepiece 34 is depressed by the impact, the barrel 16 is likewise urged backward such that the firing chamber 22 at the rear of the barrel 16 is seated onto the cartridge 24 in the breech 18. Simultaneously, as momentum continues to push the handle 50 inwardly towards the front or muzzle end 28 of the driving tool, the firing pin 26 is urged into contact with the rear of the cartridge 24. In consequence, the conical tip 42 of the firing pin 26 element is forced against the cartridge 24 with sufficient force to actuate the cartridge 24. At the moment of actuation, every element of the tool is in direct contact with every other element and the momentum of the tool is in the overhead direction.

Under the force of the explosive charge, the piston 20 is rapidly driven forward, driving the fastener 30 positioned in the barrel nosepiece 34 into the receiving substrate. The fastener's driving momentum is assisted by the user's upward bumping motion against the work surface, thus enabling the cartridge 24, piston 20 and fastener 30 to move simultaneously in the impact direction. As a result of the tool elements being in direct contact, the entire explosive power of the cartridge 24 is utilized to drive the fastener 30 into the receiving substrate. Thus, this tool achieves superior driving force over much of the prior art.

Once the piston 20 has driven the fastener 30 into the receiving substrate, the barrel biasing means 25 returns the barrel 16 to its forward position, moving breech 18 away from cartridge 24, allowing the spent combustion gases to exit the tool around cartridges 24 and through magazine channel 72 into the atmosphere. At the same time, a second biasing means returns the firing pin 26 to its rearward position. The tool is readied for use again and the process is repeated by inserting a new fastener 30 into the nosepiece 34, thus resetting the piston 20, and then manually indexing a new cartridge into the firing position.

Figure 4:
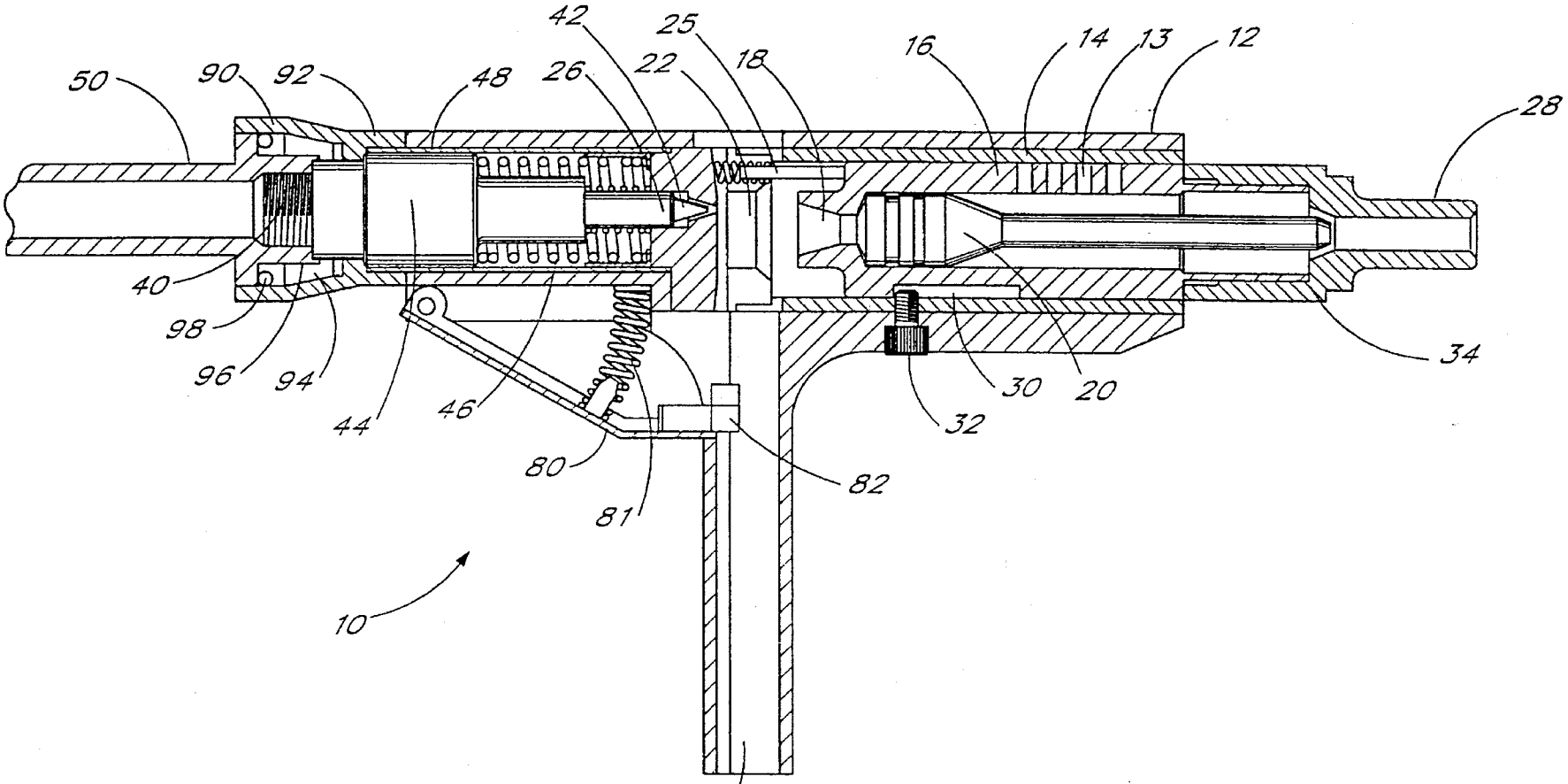
FIG. 4 is longitudinal sectional view of another embodiment of the tool with a ball lock safety device.

One of the tool, as shown in FIG. 4, includes a ball lock safety device 90 to allow discharge only when the muzzle 28 of the tool is pointed in an upward direction. The safety device 90, comprises a member 92 having a bore therethrough mounted to the rear of the housing. One end the handle 50 is threadedly engaged to the shank portion 40 of the firing pin 26 which extends through the safety device 90. When engaged with the firing pin shank 40, the handle 50 forms a substantially longitudinal internal groove 94 with a shoulder 96 within the safety device. A metal ball 98 has freedom to move within the groove 94 and will move to the rear of the groove 94 when the tool 10 is pointed upward and will move to the front of the groove 94 when the tool 10 is pointed in a downward direction. The ball 98 is sized to lodge between the shoulder 96 and the wall of the groove and thus block the axial movement of the handle 50 when the tool is pointed downward. This blocking of movement prevents discharge when the tool is pointed downward, yet permits discharge when the tool is pointed upward, as is normal when firing fasteners 30 into the ceiling. Further, the tool provides an inherently safe structure combining three safety features to prevent accidental discharge. All three safety features must cooperate before tool 10 discharge is permitted; (1) the barrel biasing means 25 requires that the muzzle 28 be axially displaced against the biasing means by presenting the fastener 30 against a surface to effect displacement of the muzzle 28, (2) the impact with the surface must be sufficient to be axially displaced and drive the firing pin 26 forward to ignite the cartridge 24, and (3) the muzzle 28 must be pointed upward, otherwise the safety ball lock 90 will prevent discharge of the tool 10.

While the invention has been particularly shown and described with reference to a preferred embodiment thereof, it will be understood by those skilled in the art that various changes in form and details may be made therein without departing from the spirit and scope of the invention. It is intended that all matter contained in the above description and depicted in the accompanying drawings be construed in an illustrative and not in a limiting sense.

What is claimed is:

1. An impact actuated tool for driving a fastener into a substrate by an explosive charge, comprising:

a housing having a bore extending therethrough, the bore having a front end spaced in a firing direction and a rear end in an opposite direction;

a barrel having a bore extending therethrough, axially slidably mounted within the front end of the bore in the housing, the barrel having a forward end in the firing direction and a breech end in the opposite direction, the barrel constrained for limited longitudinal movement relative to the housing;

means for biasing the barrel forwardly in the firing direction;

a firing chamber formed at the breech end of the barrel in communication with the barrel bore, a portion of the barrel bore within the firing chamber being configured to receive a cartridge;

a piston axially slidably mounted within the bore in the barrel;

a nosepiece with a bore extending therethrough, the nosepiece having a forward end in the firing direction which defines a muzzle and a rear end in the opposite direction which is threadedly engaged to the barrel, the bore in the rear end of the nosepiece sized to be substantially equal in diameter to the bore of the barrel, and the bore on the muzzle end of the nosepiece sized for receiving a fastener, the nosepiece being removable and interchangeable to vary the muzzle length to accommodate a plurality of fastener lengths;

means for advancing a cartridge into a firing position in the firing chamber, and simultaneously removing a spent cartridge away from the firing chamber;

a firing pin having a threaded shank portion, a conical firing pin tip and a flange, the firing pin being axially slidably mounted within the rear end of the bore in the housing and constrained for limited longitudinal movement relative to the housing;

means for biasing the firing pin rearwardly towards the rear end of said housing, said means for biasing engaging the flange on the firing pin; and a handle adapted to be grasped at a first end and engaged to the shank portion of the firing pin at a second end, whereby the handle is pushed inwardly to fire a cartridge to create combustion gases to displace the piston.

2. The tool as in claim 1, wherein a port is spaced from the breech a distance sufficiently far such that a fastener of a selected length is completely driven into the substrate before the piston clears the port.

3. The tool as in claim 1, wherein the handle, the firing pin, the cartridge, the barrel, the piston, and the fastener are in close, compressive contact when the cartridge is detonated such that the tool is effectively a solid, closed system substantially confining the explosive force and noise within the tool.

4. The tool as in claim 1, wherein the barrel includes an axial slot partially extending into an external surface of the sidewall of the barrel, and stop means for extending through the housing into the slot to limit the axial travel of the barrel.

5. An impact actuated tool, in accordance with claim 1, wherein the barrel biasing means has a lower resistance to axial compression produced by axial displacement of the barrel on contact of the muzzle with a surface than the firing pin biasing means has to axial displacement by relative movement of the tool handle whereby the barrel is axially displaced before axial displacement of the firing pin.

6. An impact actuated tool, in accordance with claim 1, wherein the muzzle is sized to a particular fastener length so that contact is maintained between the breech, the piston and the fastener prior to actuation.

7. The tool as in claim 1, wherein a plurality of ports are spaced from the breech a distance such that the combustion gases displace the piston a sufficient distance to allow the gases to expand into the plurality of the ports prior to a fastener of a selected length being completely driven into the substrate.

8. The tool as in claim 1, wherein a plurality of ports are spaced from the breech a distance such that the combustion gases displace the piston a sufficient distance to allow communication between the gases and each of the ports prior to a fastener of a selected length being completely driven into the substrate.

9. The tool as in claim 1, wherein a safety means comprises a member having a bore therethrough forming internal walls, the walls of the member forming a shoulder within the safety member, and a metal ball moveable within the member, the ball sized to lodge against the shoulder to prevent axial movement of the handle when the muzzle of the tool is in a first orientation.

10. The tool as in claim 1, wherein a safety means comprises a first member having walls, the walls of the first member forming a shoulder within the safety means and a second member moveable within the first member, the second member sized to lodge against the shoulder of the first member to prevent movement of the firing pin to fire the cartridge when the muzzle of the tool is in a first orientation.

11. The tool as in claim 1, wherein a port is spaced from the breech a distance sufficiently far such that a fastener of a selected length is completely driven into the substrate prior to the combustion gases entering a port.

12. A tool as in claim 1, wherein a plurality of apertures are formed in said barrel, said apertures being substantially closed at their outer ends by said housing to form chambers which allow the combustion gases to expand into the said expansion chambers.

13. A tool as in claim 1, wherein a plurality of apertures are sized and selectively located such that the apertures are at a location wherein said combustion gases are not permitted to expand thereinto until the fastener is completely driven into the substrate.

14. A tool as in claim 1 further comprising a safety means to prevent axial movement of the firing pin when the muzzle of the tool is oriented in a downward direction.

15. An impact actuated tool for driving a fastener by an explosive charge, comprising:

a housing having a bore extending therethrough;

a barrel, slidably mounted within the housing bore, having a bore extending therethrough, the barrel having a forward end in a firing direction and a breech end in an opposite direction, the barrel constrained for limited longitudinal movement relative to the housing;

a firing chamber formed at the breech end of the barrel in communication with the barrel bore, a portion of the barrel bore within the firing chamber being configured to receive a cartridge;

a piston axially slidably mounted within the bore in the barrel;

a nosepiece with a bore extending therethrough, the nosepiece having a forward end in the firing direction which defines a muzzle and a rear end in the opposite direction which is fixed to the barrel, the bore in the rear portion of the nosepiece being sized to be substantially equal in diameter to the bore of the barrel, and the bore on the muzzle end, of the nosepiece sized for receiving a fastener, the nosepiece being removable and interchangeable to selectively vary the muzzle dimensions to accommodate a plurality of fastener lengths;

means for advancing a cartridge into a firing position in the firing chamber, and simultaneously removing a spent cartridge away from the firing chamber;

means for biasing the barrel away from the cartridge;

a firing pin having a firing tip and a flange, the firing pin being slidably mounted within the housing bore and constrained for limited longitudinal movement relative to the housing;

means for biasing the firing pin rearwardly; and a handle adapted to be grasped at a first end and operationally coupled to the firing pin at a second end, whereby the tool is fired by displacing the handle.

16. The tool as in claim 15, wherein a port is spaced from the breech a distance sufficiently far such that a fastener of a selected length is completely driven into the substrate before the piston clears the port.

17. The tool as in claim 15, wherein the handle, the firing pin, the cartridge, the barrel, the piston, and the fastener are in close, compressive contact when the cartridge is detonated such that the tool is effectively a solid, closed system substantially confining the explosive force and noise within the tool.

18. The tool as in claim 15, wherein the barrel includes an axial slot partially extending into an external surface of the sidewall of the barrel, and stop means for extending through the housing into the slot to limit the axial travel of the barrel.

19. An impact actuated tool, in accordance with claim 15, wherein the barrel biasing means has a lower resistance to axial compression produced by axial displacement of the barrel on contact of the muzzle with a surface than the firing pin biasing means has to axial displacement by relative movement of the tool handle whereby the barrel is axially displaced before axial displacement of the firing pin.

20. An impact actuated tool, in accordance with claim 15, wherein the muzzle is sized to a particular fastener length so that contact is maintained between the breech, the piston and the fastener prior to actuation.

21. The tool as in claim 15, wherein a plurality of ports are spaced from the breech a distance such that the combustion gases displace the piston a sufficient distance to allow the gases to expand into the plurality of the ports prior to a fastener of a selected length being completely driven into the substrate.

22. The tool as in claim 15, wherein a plurality of ports are spaced from the breech a distance such that the combustion gases displace the piston a sufficient distance to allow communication between the gases and each of the ports prior to a fastener of a selected length being completely driven into the substrate.

23. The tool as in claim 15, wherein a safety means comprises a member having a bore therethrough forming internal walls, the walls of the member forming a shoulder within the safety member, and a metal ball moveable within the member, the ball sized to lodge against the shoulder to prevent axial movement of the handle when the muzzle of the tool is in a first orientation.

24. The tool as in claim 15, wherein a safety means comprises a first member having walls, the walls of the first member forming a shoulder within the safety member and a second member moveable within the first member, the second member sized to lodge against the shoulder of the first member to prevent movement of the firing pin to fire the cartridge when the muzzle of the tool is in a first orientation.

25. The tool as in claim 15, wherein a port is spaced from the breech a distance sufficiently far such that a fastener of a selected length is completely driven into the substrate prior to the combustion gases entering the port.

26. A tool as in claim 15, wherein a plurality of apertures are formed in said barrel, said apertures being substantially closed at their outer ends by said housing to form chambers which allow the combustion gases to expand into the said expansion chambers.

27. A tool as in claim 15, wherein a plurality of apertures are sized and selectively located such that the apertures are at a location wherein said combustion gases are not permitted to expand thereinto until the fastener is completely driven into the substrate.

28. A tool as in claim 15 further comprising a safety means to prevent axial movement of the firing pin when the muzzle of the tool is oriented in a downward direction.

* * * * *